United States Patent [19]

de Vries et al.

[11] 4,427,518

[45] Jan. 24, 1984

[54] ELECTROPLATING DEVICE

[75] Inventors: Hans de Vries, Heerde, Netherlands; Siegfried Birkle, Höchstadt, Fed. Rep. of Germany; Klaus Stoeger, Nuremberg, Fed. Rep. of Germany; Johann Gehring, Spardorf, Fed. Rep. of Germany

[73] Assignee: Siemens Aktiengesellschaft, Berlin & Munich, Fed. Rep. of Germany

[21] Appl. No.: 383,979

[22] Filed: Jun. 1, 1982

[30] Foreign Application Priority Data

Jul. 10, 1981 [DE] Fed. Rep. of Germany ..... 3127390

[51] Int. Cl.[3] ..... C25D 17/20

[52] U.S. Cl. ..... 204/201; 204/275

[58] Field of Search ..... 204/201, 225, 275, 277

[56] References Cited

U.S. PATENT DOCUMENTS 1,912,400 6/1933 O'Neill ..... 204/201
2,133,324 10/1938 Hosdowich ..... 204/201
4,053,383 10/1977 Dötzer et al. .
4,360,409 11/1982 Stoeger ..... 204/277

FOREIGN PATENT DOCUMENTS 2165614 1/1973 Fed. Rep. of Germany ..... 204/201
45-32604 8/1966 Japan ..... 204/201

*Primary Examiner*—T. M. Tufariello
*Attorney, Agent, or Firm*—Hill, Van Santen, Steadman & Simpson

[57] ABSTRACT

A device for continuously processing an article such as by electroplating including a tank equipped with a horizontally disposed rotating electroplating drum, an entry station disposed for introducing an article to one end of the drum and an exit station for removing the processed article from the drum. The electroplating tank as well as the entrance and exit stations are provided with gas-tight seals so that the device may be utilized for an oxygen-free and water-free aluminum-organic electrolyte for the electrodeposition of aluminum. Preferably, the entrance and exit stations contain liquid locks to prevent the controlled atmosphere above the electrolyte from being contaminated.

13 Claims, 3 Drawing Figures

ELECTROPLATING DEVICE

BACKGROUND OF THE INVENTION

The present invention is directed to a device for processing objects such as by electrolytic precipitation of metal on the object. The device includes a container such as an electroplating tank for receiving an electrolyte, a drum which has an open entrance and an exit end and is mounted in the tank for rotation on a longitudinal axis which is substantially horizontal, an arrangement for introducing objects into the entrance end of the drum and also an arrangement for removing the processed objects. When the device is used for electroplating an object, the container, which contains an electrolyte, has at least one anode of a voltage source and an arrangement for connecting the objects being processed to the cathode of the voltage source.

A device for electroplating small objects, which devices utilize a drum disposed in an electroplating tank connected to one pole of a voltage source, whose anode is disposed in the electroplating tank or vessel, is known. The entirely closable drum is filled with a charge of objects to be electroplated and is then introduced into the electrolyte bath where it is turned for a predetermined time. However, such device is not suitable for a continuous electroplating process. Moreover, the device is not suitable in an electroplating process, such as an electrodeposition of a metal from an oxygen-free and water-free electrolyte wherein the atmosphere consisting of inert gas must be maintained over the electrolyte during the entire operation.

A device, which has an electroplating tank with an annular electrolyte trough, is disclosed in the U.S. Pat. No. 4,053,383, which was based on German application No. 2,537,256. In the device of the U.S. patent, whose disclosure is incorporated by reference, the annular electrolyte trough has an inner wall and an outer wall which is higher than the inner wall. The inner wall is closed by means of a plate-shaped wall part and the outer annular wall of the trough which extends to a higher level is closed by a cover. A contacting device is provided between the plate-shaped wall part and the cover and this contacting device has a series of brackets whose inside ends are connected to a rotational axis of a drive mechanism. The other end of each bracket projects above the electrolyte in the annular trough and serves as a point of support for the suspension of a frame for supporting or holding articles in the electrolyte during the plating process. These support frames are first introduced into a locked chamber, which is positioned above the cover of the electrolyte trough, and the chamber is thus filled with an inert gas. After the chamber is filled with an inert gas, the support frames are then lowered through a closable door into the electroplating tank and are positioned or suspended on the ends of the brackets. The removal of the support frame occurs in reverse sequence. Thus, this device enables processing an object such as by electroplating the object or article while maintaining a protective atmosphere in the device.

However, the device of this particular patent is only suitable for electroplating objects or articles which can be secured in the support frames. It is uneconomical to use this device for electroplating small objects with a large number of pieces such as bolts, nuts, screws, spacing bushings and the like because the chucking or holding of each of the individual articles would require too many manipulative steps and therefore would be too expensive.

SUMMARY OF THE INVENTION

The present invention is directed to a device which enables processing small articles, such as by electroplating, in a continuous process without the need of each of the articles to be chucked or held in a support member.

To accomplish these objects, the device for processing an object or article by contacting the article with a processing medium comprises a container or receptacle for the processing medium; a cylindrical drum with a longitudinal axis; and open entrance end and an open exit end; means for mounting said drum in the container for rotation on said longitudinal axis with the longitudinal axis being substantially horizontal; means for introducing the article to be processed into the entrance end of the drum including a first means for conveying the article into the entrance end; means for removing the processed article from the exit end of the drum including a second means for conveying the article from the exit end and means for guiding the article to be processed through the drum from the entrance end to the exit end. The device of the present invention is particularly useful in electrolytically processing an article such as by precipitating a metal onto the object or article. In such an instance, the receptacle is a tank for receiving an electrolyte and will have at least one electrode connected to a pole of a voltage source. The mounting of the cylindrical drum is such that at least a portion of the drum will be covered with the electrolyte in the tank or container and there is means disposed in the drum for electrically contacting the article to the other pole of the voltage source.

Because of the means for introducing, which form an entry station, an object or article to be processed, such as electroplated, is introduced into one open end of the rotatable drum. As a result of the means for guidance in the drum, the object is gradually conveyed to the other open or exit end of the drum where the means for removing at an exit station will remove the processed article.

In the preferred embodiment of the device, which is particularly intended for electrodeposition of aluminum from an aluminum-organic electrolyte, which is oxygen-free and water-free from the very outset, the electroplating tank is provided in an enclosed, gas-tight container where inert gas can be introduced and maintained over the electrolyte. In order to maintain this inert gas atmosphere over the electrolyte, the entry and exit stations will contain lock means which enable introducing and removing the article without introducing unwanted elements or gases such as oxygen into the inert atmosphere. Each of these lock means preferably is a fluid lock. Preferably, each of the fluid locks comprise a reservoir or cavity which is spaced from the electrolyte bath by a first partition, which has an upper edge terminating above the level of the electrolyte. This reservoir is filled with a second liquid to a level just below the edge of the first partition and has a second partition spaced from the first partition which extends from the upper part of the housing down into and below the level of the second liquid. Thus, any object being introduced through the liquid lock must pass through this second liquid underneath the second partition. For example, the article enters an opening in the housing of the lock, passes through the second liquid for introduction into the electrolyte in the electrolyte tank. In a similar manner an object being removed from the electrolyte must pass through this second liquid under the second partition before it can be removed from the housing of the lock.

DESCRIPTION OF THE PREFERRED EMBODIMENTS

Figure 1:
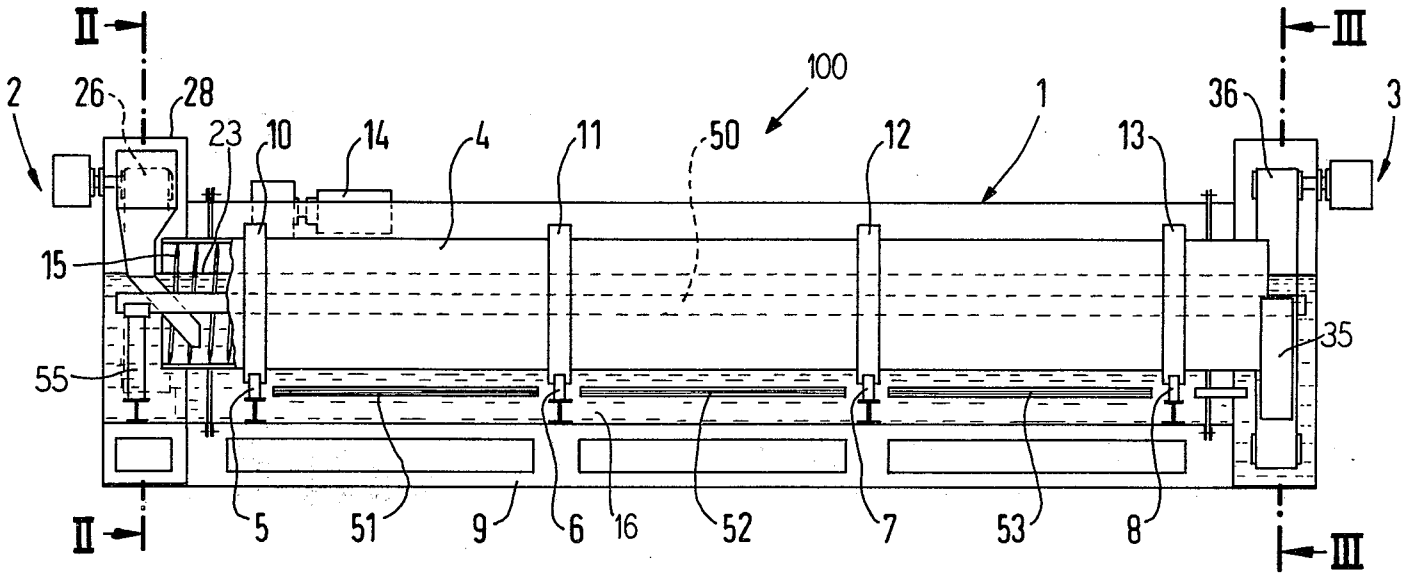
FIG. 1 is a longitudinal cross-sectional view of the device of the present invention with portions in elevation for purposes of illustration.

The principles of the present invention are particularly useful in a device generally indicated at 100 in FIG. 1. Briefly, the device 100 includes an elongated vessel or receptacle 1 such as an electroplating tank which is completely enclosed. The tank or vessel 1 at one end has an entry station 2, which is arranged with its principal axis extending at right angles to the vessel or tank 1, and on the other end has an exit station 3, which also has a principal axis at right angles to the longitudinal direction of the tank 1. As illustrated, the tank 1 and the entrance station 2 and 3 are each arranged on a foundation or support 9.

Figure 2:
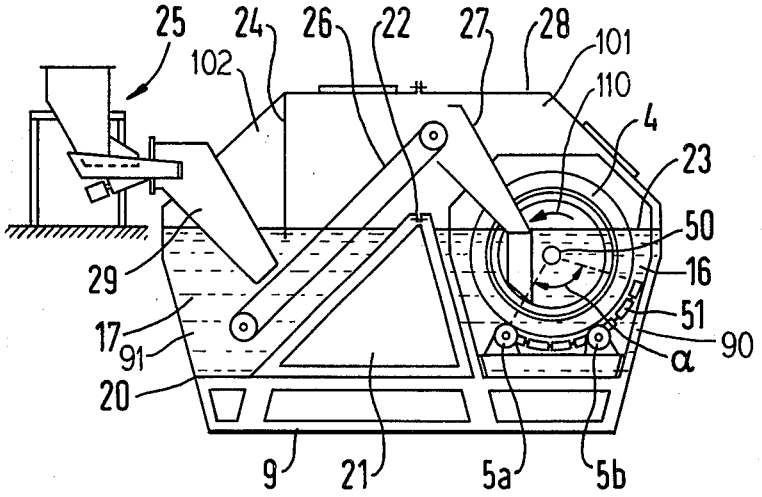
FIG. 2 is a cross-sectional view taken along the lines II—II of FIG. 1.
Figure 3:
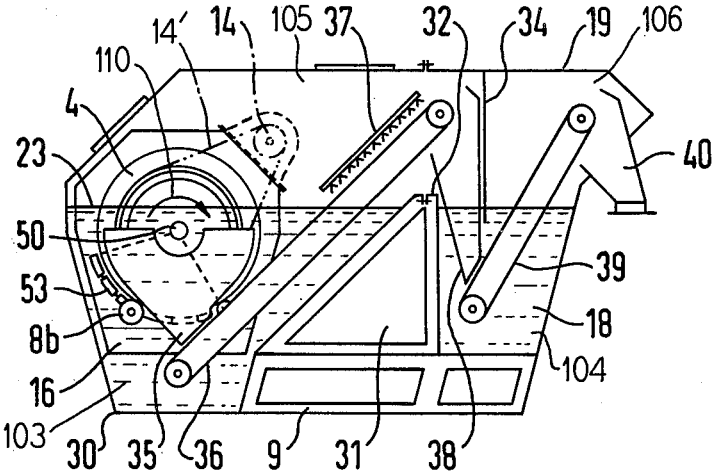
FIG. 3 is a cross-sectional view taken along the lines III—III of FIG. 1.

The tank 1, which is elongated with its longitudinal axis being substantially in a horizontal plane, contains an electrolyte 16 which has an upper surface 23. The tank 1 has means for supporting or mounting a cylindrical drum 4 which has an open entrance end and an open exit end in the tank 1 for rotation with a majority of the drum disposed below level 23 of the electrolyte 16. As illustrated, the means for supporting supports the drum 4 with its longitudinal axis extending substantially horizontal in the tank 1 and is composed of a plurality of axially space-apart roller pairs or units 5, 6, 7 and 8. Each of the pairs such as the pair 5 has a pair or two spaced-apart rollers such as 5*a* and 5*b* (FIG. 2) which are secured in the tank 1. It is noted that the other rollers in the pairs 6, 7 and 8 will be aligned with the two rollers 5*a* and 5*b*. The longitudinally or axially spaced roller pairs 5, 6, 7 and 8 engage or receive axially spaced-apart stiffening or guidance rings or tracks such as 10, 11, 12 and 13 which are secured on the drum 4. In order to rotate the drum 4, a drive means comprising a drive unit 14 is provided in the tank 1. As illustrated in FIG. 3, the drive means has an appropriate means such as a belt 14' which engages a portion of the drum 4 to rotate the drum on its longitudinal axis as it is supported by the mounting means.

In order to guide and move articles which are to be processed in the fluid such as the electrolyte 16 through the drum 4, the drum is provided with means for guiding the articles from the entrance end to the exit end. As illustrated, the means for guiding comprises a helical rib, which is secured on an inner surface of the cylindrical drum 4. Thus, when the drum rotates, this helical rib will cause the small objects which are being processed to be gradually conveyed from the entrance station 2 to the exit station 3. Instead of a single helical rib, a plurality of interlocking helical ribs can also be utilized.

In order to control the atmosphere in the space above the surface 23 of the fluid 16, the tank has means for introducing the desired atmosphere and both the entry station 2 and the exit station 3 are provided with lock means such as a liquid lock to enable introduction and removal of an article to tank 1 without introducing oxygen, water or other undesirable elements into either the electrolyte or the inert atmosphere above the electrolyte level 23. To accomplish this, the entrance station 2 has a housing 20 which has its major longitudinal direction extending perpendicular to the longitudinal axis of the drum and the tank 1. As best illustrated in FIG. 2, a partition 21 having an upper edge 22 which extends above the level 23 of the electrolyte 16 in the tank 1 divides the housing into two portions 90 and 91 with the portion 90 on the right-hand side of FIG. 2 being in fluid communication with the tank 1 and receiving electrolyte 16 while the portion 91 on the left-hand side of the partition 21 is filled with the fluid or liquid 17, for example, toluol, up to a level just below the upper edge 22 of the partition 21. A second partition 24 extends from an upper portion 28 of the housing 20 down into and below the liquid level of the second liquid 17. Thus, coaction of the liquid 17 and the partition 24 separates the space above the liquids into a portion 101 of the housing 20, which is in communication with the atmosphere above the electrolyte 16, from a portion 102. Thus, the inert atmosphere in this portion 101, which is in the space above the electrolyte, will be closed off from the space 102 which is in communication with an opening extending to the ambient atmosphere outside of the tank. Thus, no oxygen can enter into the space 101.

In order to introduce objects into the drum 4, conveying means which include the feed funnel 29 and a first conveying belt 26 are provided. As illustrated, the conveying means also includes a metering rocking conveyor 25 which discharges into the funnel 29 of the station 2. The conveyor belt 26 is mounted in the station to pass beneath the partition 24 with its bottom end disposed in the fluid 17 beneath the exit of the funnel 29. The other end of the conveyor 26 extends over the first partition 21 into the space 101 and discharges into a funnel 27 whose exit end extends into the entrance end of the drum 4. Thus, objects, which are introduced through the meter rocking conveyor 25 into the funnel 29, are carried by the belt 26 for discharge into the funnel 27 which extend into the entrance end of the drum 4.

As already mentioned, objects, which are disposed at the entrance end of the drum 4, are carried from the entrance station 2 toward the exit station 3 by the helical rib 15 that forms the guidance means.

The exit station 3 is similar to the entrance station 2 and also has an enclosed housing 30, which has a partition 31 which subdivides the space of the housing into two portions 103 which is in communication with the electrolyte 16 in the tank 1 and a portion 104 which contains a third fluid 18. As with the entrance station 2, the partition 31 has an upper edge 32 which is above the level 23 of the electrolyte and the third fluid, for example, toluol, fills up the second portion to a level below the edge 32. As in the previous embodiment, the housing 30 has a second partition 34, which extends downward from an upper portion 19 and has its lower edge immersed in the fluid 18. Thus, the coaction of the fluid 18 and the second partition 34 subdivide an upper portion 19 of the housing into one chamber 105 which is in communication with the atmosphere above the electrolyte 16 in the tank 1 and a second portion 106 which is isolated from the inert atmosphere in the electrolyte tank and may be in communication with the atmosphere outside of the tank 1.

To remove the objects, such as electroplated objects, which are being discharged from the exit end of the drum 4, the station 3 has conveying means which include a funnel-shaped discharge 35, a conveying belt 36, a funnel-shaped part 38, another conveyor belt 39 and funnel-shaped muff or part 40. The conveying belt 36 has its lower end immersed in the electrolyte in a position to receive the discharge from the funnel discharge 35 which receives and guides articles being discharged from the drum 4 onto the conveyor 36. The other end of the conveyor belt 36 is positioned above the electrolyte on the opposite side of the upper edge 32 of the partition 31. Thus, the electroplated object will be transported from the electrolyte 16 by the conveyor belt 36. To clean the articles of any adhering electrolyte before they leave the conveyor belt 36, a series of spray nozzles 37 wash or spray the articles with a liquid. The liquid, for example, toluol, is a component of the electrolyte.

After being sprayed with the fluid or liquid from the nozzles 37, the cleaned objects are discharged from the upper end of the conveyor belt 36 and, preferably, are received in the funnel-shaped structural part 38 which has a discharge arranged in the fluid 18 adjacent the lower end of the other or second conveyor belt 39 which extends under the second partition 34. The upper end of the conveyor belt 39 extends into the chamber or portion 106, which is isolated from the portion 105 by the partition 34, and discharges into the funnel-shaped muff 40 which forms a discharge for the device 100.

The device 100 is illustrated as an electrolytic plating device and has an elongated anode 50, whose ends are supported in an insulated manner by a support 53 to be disposed on the axis of the rotating drum. The anode 50 is connected to one pole on the voltage source in a known manner. In the preferred embodiment of the invention, the drum 4 is manufactured of a perforated material and additional bent plate-like anodes such as 51, 52 and 53 are disposed or spaced along the outer surface of the drum. As illustrated in FIG. 2, these plate-shaped anodes such as 51 preferably extend over an angle $\alpha$, which is selected in such a manner that the plate-shaped anodes are in close proximity during the electroplating process to the object to be electroplated. It is noted that the objects being electroplated will creep up one side of the drum due to the rotation of the drum in the direction of arrow 110.

In order to contact the articles with the other pole of the voltage source and thus have them connected to the cathode, means are disposed in the drum for forming an electrical contact. This means can be the drum itself or when the drum 4 is made of a synthetic material, the means for contacting can be formed by the presence of special contact elements on the inside surface of the drum which may be the helical rib 15.

The device 100 is particularly useful for electrodepositing aluminum from an oxygen-free and water-free aluminum-organic electrolyte. However, it can be easily seen that the device can also be employed for the precipitation of other metals from corresponding electrolytes.

The device 100 can be used for all electroplating processes in which the entrance of oxygen must be avoided during the process because the oxygen would cause a deterioration of the electrolyte. The device 100 can also be used when vapors which are present during the electrolytic process form undesirable compounds with oxygen and therefore it is necessary to keep oxygen from coming in contact with the electrolyte.

It is self-understood that the device 100 is not restricted to the particular embodiment illustrated but rather that various modifications and alterations can be made without leaving the framework of the invention. For example, it is possible to employ bucket conveyors instead of the belt conveyors such as 26 and 36. The meter rocking conveyor 25 at the input station can be replaced by some other type of transport mechanism, for example, a belt conveyor or a screw conveyor or the like. The disposition of the entry station 2 and the exit station 3 relative to the electroplating tank 1 can also be selected in such a manner that they do not need to have their major axis lie at right angles to the longitudinal axis of the tank 1 but rather can extend parallel to one another or in other arrangements depending on the particular shape of the space in which the system must be disposed.

The means forming the guidance instead of being the helical rib 15 or plurality of ribs can also be composed of a plurality of loose scoops or paddles which are arranged relative to one another in such a manner that will cause axial movement of the article in the axial direction as the drum is rotated.

When utilizing liquid locks as the sealing or locking means in the stations, the second liquid such as the liquids in the baths 17 and 18 should be selected to be compatible with the electrolyte being utilized in the tank 1. In the particular description of the embodiment for aluminum plating, toluol is compatible and does form a component of the electrolyte of the bath 16.

Instead of utilizing liquid locks as a means for preventing the atmosphere from coming in contact with the electrolyte, other locking means such as gas locks can be utilized.

Although various minor modifications may be suggested by those versed in the art, it should be understood that we wish to employ within the scope of the patent granted hereon all such modifications as reasonably and properly come within the scope of our contribution to the art.

We claim:

1. A device for electrolytic processing articles by electrodepositing of aluminum from an oxygen-free and a water-free aluminum-organic electrolyte onto the article, said device comprising an enclosed gas-tight tank for receiving said electrolyte, said tank having means for providing a protective atmosphere in contact with the electrolyte disposed therein and having at least one electrode connected to a pole of a voltage source; a cylindrical drum with a longitudinal axis, an open entrance end and an open exit end; means for mounting said drum in the tank for rotation on said longitudinal axis with said longitudinal axis of the drum being substantially horizontal and a portion of said drum covered with said electrolyte; means for guiding articles to be processed through said drum from the entrance end to the exit end; means disposed in said drum for electrically contacting each of said articles to connect them to the pole of said voltage source; means for introducing articles to be processed into the entrance end of said drum including a first means for conveying articles into the entrance end and first lock means for preventing introduction of undesirable components to the protective atmosphere above the electrolyte, said first lock means including an enclosed housing having an exit opening in communication with the tank and an aperture, said housing having a first partition to separate a portion of the housing in communication with the electrolyte through the exit opening from a second fluid disposed in said housing, a second partition extending from an upper portion of said housing below the level of the fluid in said second portion to isolate the aperature of the housing from the protective atmosphere disposed above said electrolyte, said first means for converging comprising a conveyor belt having an upper end extending over the first partition and a lower end disposed in said second fluid and underneath the second partition for receiving articles introduced into said housing through the aperature; and means for removing processed articles from the exit end of the drum including a second lock means for preventing introduction of undesirable components to the protective atmosphere above the electrolyte, said second lock means having an enclosed housing with an entrance opening communicating with the tank and a discharge port, said housing have a first partition to separate a portion of the housing in communication with the electrolyte through the entrance opening from a second fluid disposed in said housing, a second partition extending from an upper portion of said housing below the level of fluid in said second portion to isolate the discharge port of said housing from the protective atmosphere disposed above said electrolyte, said means for removing including a second means for conveying the article from the exit of the tank including a conveyor extending into the second fluid beneath the second partition with an upper end being arranged to discharge to the discharge port, said lower end being arranged to receive articles deposited in the second fluid.

2. A device according to claim 1, wherein the means for introducing include a metering conveyor for introducing the articles through said aperture in the housing of the means for introducing for depositing on one end of the conveyor belt.

3. A device according to claim 1, wherein the upper end of the conveyor belt is disposed above a funnel having a lower end extending into the open entrance end of the drum.

4. A device according to claim 1, wherein the second conveying means includes an additional conveyor belt having one end disposed in the electrolyte for receiving articles discharged from the exit end of the drum, said additional conveyor extending over the first partition for discharging into the second liquid and onto the lower end of the first-mentioned conveyor belt.

5. A device according to claim 4, wherein the additional conveyor belt discharges into a funnel-shaped structural member whose exit end deposits articles on the lower end of the first-mentioned belt.

6. A device according to claim 5, wherein the means for removing includes spray nozzles arranged to remove excess electrolyte from the electroplated articles as they are being raised from the electrolyte by the additional conveyor belt.

7. A device according to claim 1, wherein the conveyors of said means for introducing and means for removing move along a path extending substantially at right angles to the longitudinal axis of the drum.

8. A device according to claim 1, wherein the means for guiding comprise at least one helical rib projecting from the interior surface of the drum.

9. A device according to claim 1, wherein an electrode is disposed on the interior of the rotating drum.

10. A device according to claim 1, wherein the drum is composed of a perforated material.

11. A device according to claim 10, wherein plate-shaped electrodes are positioned outside of the drum along the length of the drum.

12. A device according to claim 1, wherein the drum consists of a synthetic material and the means for electrically contacting and connecting the articles to the other pole of said voltage source comprise contact elements disposed on the inner surface of the drum.

13. A device according to claim 12, wherein the means for guiding comprise at least one helical metal rib projecting from the inner surface of the drum, said metal helical rib simultaneously acting as the contact elements.

* * * * *